US009776700B2

(12) United States Patent
Beachy Head

(10) Patent No.: US 9,776,700 B2
(45) Date of Patent: Oct. 3, 2017

(54) OUTBOARD MOTOR

(71) Applicant: Michael Alan Beachy Head, Newlands (ZA)

(72) Inventor: Michael Alan Beachy Head, Newlands (ZA)

( * ) Notice: Subject to any disclaimer, the term of this patent is extended or adjusted under 35 U.S.C. 154(b) by 0 days.

(21) Appl. No.: 15/317,884

(22) PCT Filed: Jun. 12, 2015

(86) PCT No.: PCT/IB2015/054448
§ 371 (c)(1),
(2) Date: Dec. 9, 2016

(87) PCT Pub. No.: WO2015/189808
PCT Pub. Date: Dec. 17, 2015

(65) Prior Publication Data

US 2017/0106958 A1 Apr. 20, 2017

(30) Foreign Application Priority Data

Jun. 12, 2014 (GB) ..... 1410476.4

(51) Int. Cl.

| | |
|---|---|
| ***B63H 20/10*** | (2006.01) |
| ***B63H 20/16*** | (2006.01) |
| ***B63H 23/34*** | (2006.01) |
| ***B63H 23/30*** | (2006.01) |
| ***B63H 20/20*** | (2006.01) |

(52) U.S. Cl.
CPC ..... *B63H 20/16* (2013.01); *B63H 20/10* (2013.01); *B63H 20/20* (2013.01); *B63H 23/30* (2013.01); *B63H 23/34* (2013.01); *B63B 2749/00* (2013.01)

(58) Field of Classification Search
CPC ..... B63H 20/12; B63H 20/10
See application file for complete search history.

(56) References Cited

U.S. PATENT DOCUMENTS

| | | | | |
|---|---|---|---|---|
| 3,084,657 A | | 4/1963 | Kiekhaefer | |
| 3,447,504 A | * | 6/1969 | Shimanckas | B63H 23/04 440/75 |
| 5,224,888 A | * | 7/1993 | Fujimoto | B63H 20/12 248/641 |

(Continued)

FOREIGN PATENT DOCUMENTS

| | | |
|---|---|---|
| DE | 19900003 A1 | 7/2000 |
| GB | 2098155 A | 11/1982 |
| JP | S58209692 A | 12/1983 |

OTHER PUBLICATIONS

International Search Report for PCT/IB2015/054448, dated Oct. 29, 2015, 4 pgs.

*Primary Examiner* — Edwin Swinehart
(74) *Attorney, Agent, or Firm* — Haynes and Boone, LLP

(57) ABSTRACT

An outboard motor includes a lower unit and an upper unit that is attachable to the stern of a boat, with the upper unit and lower unit configured to tilt together about a transverse tilt axis. The upper unit includes an engine, a transmission assembly and a drive shaft and the lower unit includes a lower unit housing and a propeller shaft that is connected to the drive shaft. The lower unit housing is configured to pivot relative to the upper unit, about a steering axis that extends coaxially with the drive shaft. The steering axis intersects the propeller axis at an obtuse angle.

9 Claims, 6 Drawing Sheets

(56) References Cited

U.S. PATENT DOCUMENTS

| | | | | |
|---|---|---|---|---|
| 5,536,187 | A * | 7/1996 | Nanami | B63H 11/08 440/38 |
| 7,588,473 | B2 * | 9/2009 | Beachy Head | B63H 5/1252 440/53 |
| 7,662,005 | B2 * | 2/2010 | Provost | B63H 5/125 440/53 |

* cited by examiner

OUTBOARD MOTOR

CROSS REFERENCE TO RELATED APPLICATIONS

This application is a United States national phase of co-pending international patent application No. PCT/IB2015/054448, filed Dec. 17, 2015, which claims priority to Great Britain application No. GB1410476.4, filed Jun. 12, 2014, the entire disclosures of which are incorporated by reference in their entirety.

FIELD OF THE INVENTION

This invention relates to drives for propulsion of marine vessels (boats). In particular, the invention relates to outboard motors.

BACKGROUND TO THE INVENTION

A conventional outboard motor is a self-contained unit that can be fitted on the transom of a boat and that includes an engine, transmission and propeller (or jet drive). The entire unit can pivot relative to the transom about a vertical steering axis, to control the direction of thrust from the propeller—and thus steer the boat. The entire unit can also be pivoted relative to the transom about a transverse, horizontal trim/tilt axis, to trim the angle of attack of the thrust and/or to tilt the unit up, e.g. when not in use.

The conventional configuration of an outboard motor includes an engine in an upper part (power head)—typically with a vertical crank shaft, although horizontal crank shafts have also been used. A drive shaft extends vertically from the motor in a mid-section that also typically houses an exhaust. A lower unit houses a gearbox, where power is transmitted from the vertical drive shaft to a horizontal propeller shaft. The power head, mid-section and lower unit are attached together to form a single unit that pivots about the steer axis and trim/tilt axis, as described above.

The configurations of these motors, which include attachments to the boat's transom that allows the entire motor to pivot about its steering axis and about its trim/tilt axis is complicated—partly due to the multiplicity of pivot axes and partly because the entire engine needs to pivot about these axes—which can require large forces in the case of larger motors and which requires adequate space for the entire unit to pivot. In order to accommodate these pivotal movements, the units are usually supported well aft of the transom, but the distance between the unit and the transom provides a moment arm and increases forces on the transom. The forces required to pivot these units, as well as the forces exerted on the transom, limit the use of outboard motors to relatively small motors.

In many cases, stricter limitations on exhaust emissions are applied to inboard motors than to outboard motors and compliance with emissions limitations increase manufacturing costs—resulting in cost benefits from using outboard motors. However, only smaller engines have conventionally been used in outboard configurations and the use of larger engines in outboard motors tends to be too complex, cumbersome and/or costly.

The most common design for the sterns of modern leisure power boats includes a planar transom that is either vertically orientated or is very steeply inclined ("raked"—i.e. angled aft with a small "transom angle" relative to vertical). If a particular motor configuration requires deviation from a standard stern design offered by a hull manufacturer, the motor configuration can only be used if the hull manufacturer offers an alternative stern design (which increases tooling and/or manufacturing costs) or a standard hull needs to be modified after manufacture (also at considerable cost and/or detriment to hull quality). Accordingly, there is significant resistance to marine motor configurations that require deviation from conventional, standard transom designs.

A stern drive has been disclosed in WO2012/168767, which uses a drive configuration that is simple and compact and can accommodate engines in various space-saving configurations, but the drive uses an inboard motor, which requires adherence to strict emissions limitations. Further, the stern drive requires a non-standard transom angle of about 45 degrees. The stern drive disclosed in WO2012/168767 holds benefits in handling and performance resulting from an inclined steering axis.

The present invention seeks to provide a marine propulsion system that uses an outboard motor, is relatively simple and cost effective, can be fitted on a conventional transom, can use a relatively large motor, makes effective use of space and provides good handling and performance.

SUMMARY OF THE INVENTION

According to the present invention there is provided an outboard motor comprising an upper unit that is attachable to the stern of a boat and a lower unit that is attached to the upper unit; the upper unit and lower unit being configured to pivot together about a tilt axis that extends transversely relative to a longitudinal axis of the boat; the upper unit including an engine, a transmission assembly and a drive shaft; and the lower unit including a lower unit housing supporting a propeller shaft that is connected to receive motive power from the drive shaft, said propeller shaft being supported in the lower unit housing to rotate about a propeller axis; wherein the lower unit housing is configured to pivot relative to the upper unit about a steering axis that extends coaxially with the drive shaft; and wherein the steering axis intersects the propeller axis at an obtuse angle.

The steering axis may intersects the propeller axis at an angle between 100 degrees and 140 degrees, e.g. at an angle of about 120 degrees.

The transmission assembly may include:

an input shaft that is connected to receive motive power from the engine;

a clutch shaft that is connected to receive motive power from the input shaft, said clutch shaft extending perpendicular to the drive shaft;

a pivot gear set of bevel gears for transferring motive power from the input shaft to the clutch shaft; and a clutch assembly configured to transfer motive power selectively from the clutch shaft to the drive shaft.

The pivot gear set may be aft of the clutch assembly.

The input shaft may extend at an acute angle relative to the longitudinal axis of the boat when the outboard motor is in a tilted down operational orientation, e.g. the input shaft may extends at an angle of between 20 degrees and 70 degrees or about 45 degrees relative to the longitudinal axis of the boat.

The axis of the clutch shaft may be in a generally vertical plane that extends parallel to the longitudinal axis of the boat.

BRIEF DESCRIPTION OF THE DRAWINGS

For a better understanding of the present invention, and to show how it may be put to effect, the invention will now be described by way of non-limiting example, with reference to the accompanying drawings in which.

DETAILED DESCRIPTION

Figure 1:
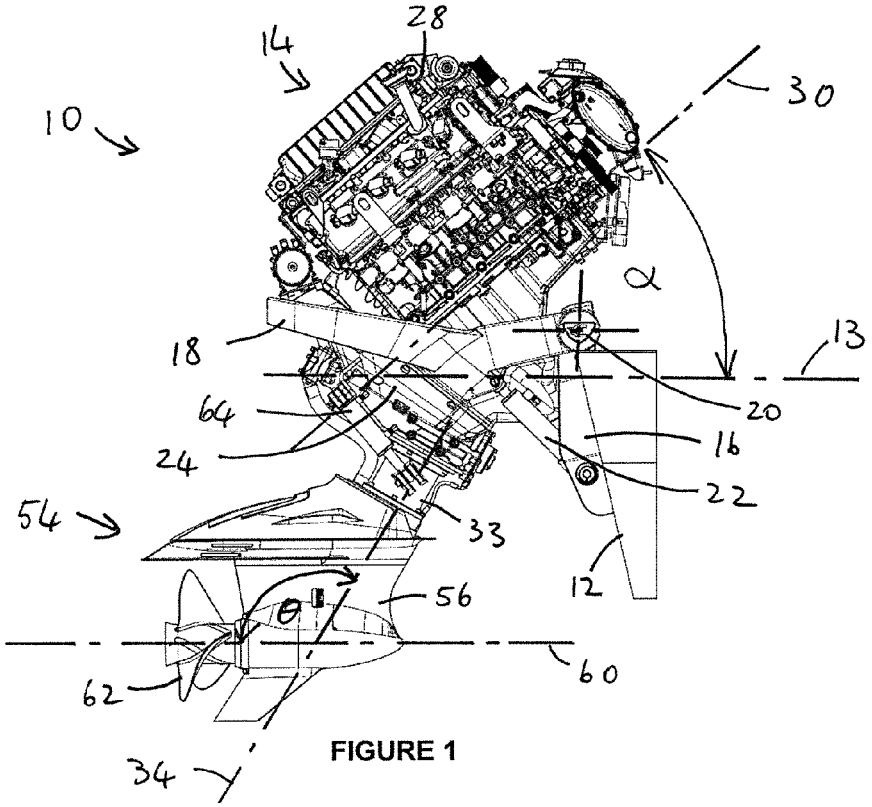
FIG. 1 is a starboard side view of an outboard motor according to the present invention, with its cowling and some covers removed, in its normal, tilted down operational orientation.
Figure 2:
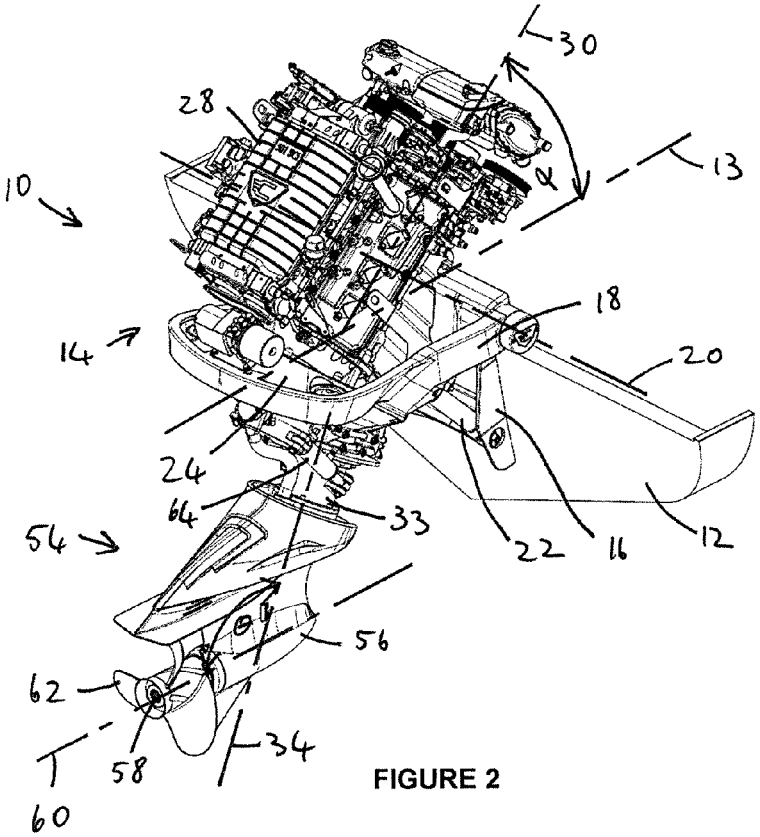
FIG. 2 is an isometric, aft, starboard view of the outboard motor of FIG. 1.
Figure 3:
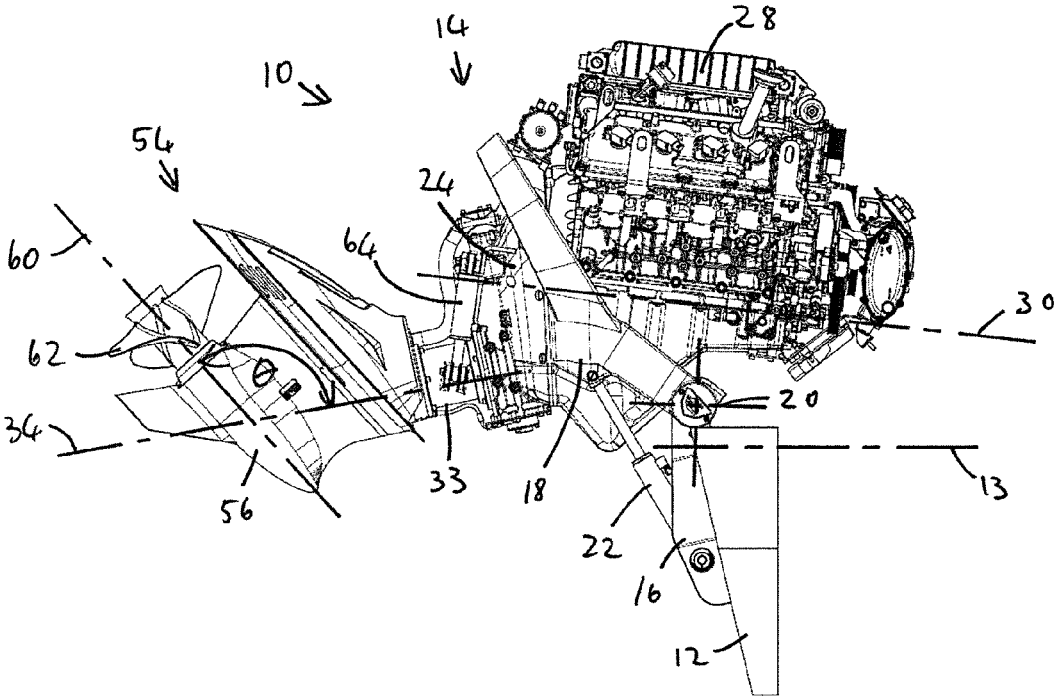
FIG. 3 is a starboard side view of the outboard motor of FIG. 1, tilted up.
Figure 4:
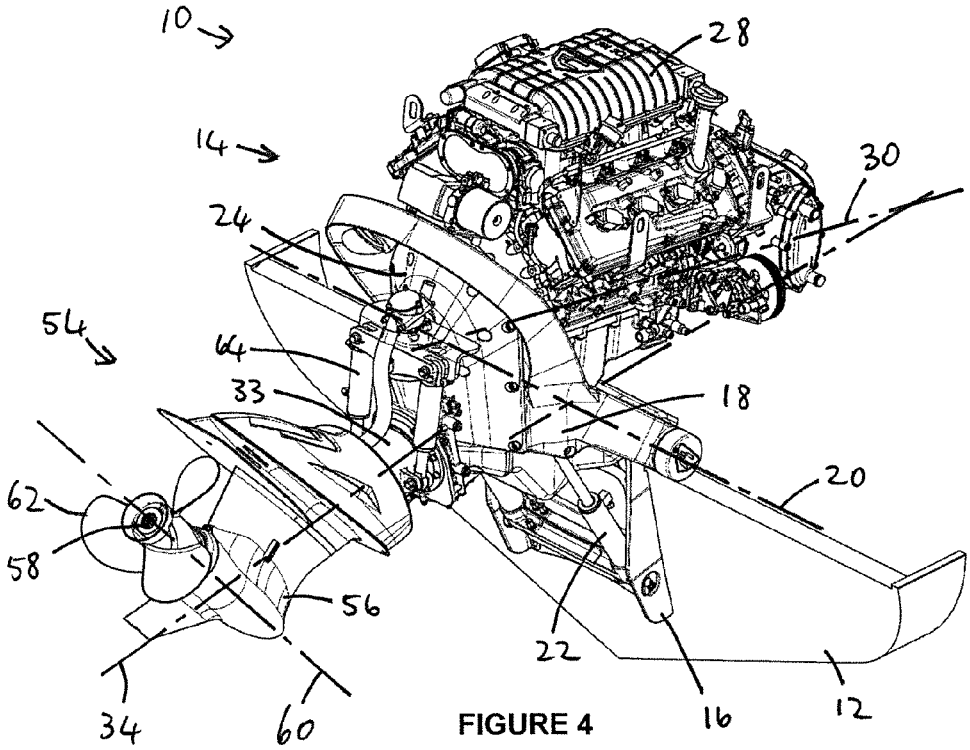
FIG. 4 is an isometric, aft, starboard view of the tilted up outboard motor of FIG. 3.

Referring to the drawings, an outboard motor according to the present invention is generally identified by reference numeral 10.

The outboard motor 10 is installed on the stern of a boat, e.g. it can be attached to a transom 12 of the boat and in the example, the transom is conventionally raked—e.g. at an angle of 10 degrees relative to vertical, although the invention can be used with various other attachments to the stern of a boat. The boat hull is not shown in the drawings, but the transom 12 is oriented transversely in relation to a longitudinal axis 13 of the boat. The outboard motor 10 includes an upper unit 14 that is attached to the transom 12 by a fixed mounting bracket 16 that is attached to the transom and a pivoting mounting bracket 18 that supports the upper unit 14. The pivoting mounting bracket 18 serves the purpose of a bracket, but also forms a unitary part with the crank casing of the engine 28 and supports the gearbox 24 (to which reference is made below). The fixed and pivoting mounting brackets can take various other forms, as long as they attach support the outboard motor on the stern of the boat. The pivoting mounting bracket 18 is pivotally attached to the fixed mounting bracket 16, to pivot about a trim axis 20 that extends in a transverse direction relative to the axis 13, i.e. generally parallel to the top of the transom, in the illustrated embodiment. Accordingly, the upper unit 14 (and thus also the lower unit—as will be described below) can pivot about the trim axis 20 to trim and/or tilt the outboard motor 10 and this can be actuated by a pair of hydraulic cylinders 22, or other means.

Figure 9:
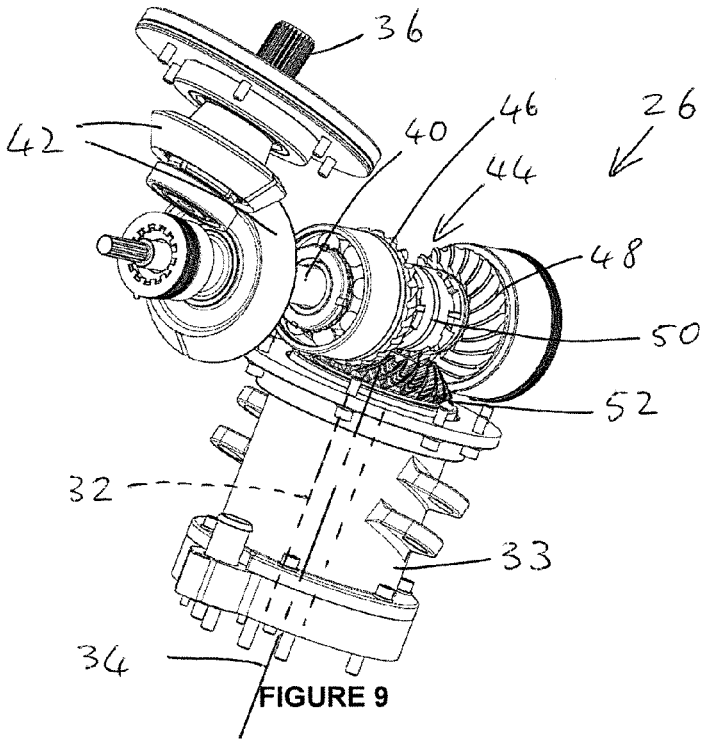
FIG. 9 is an isometric, aft, starboard view of transmission assembly components of the outboard motor of FIG. 1.
Figure 10:
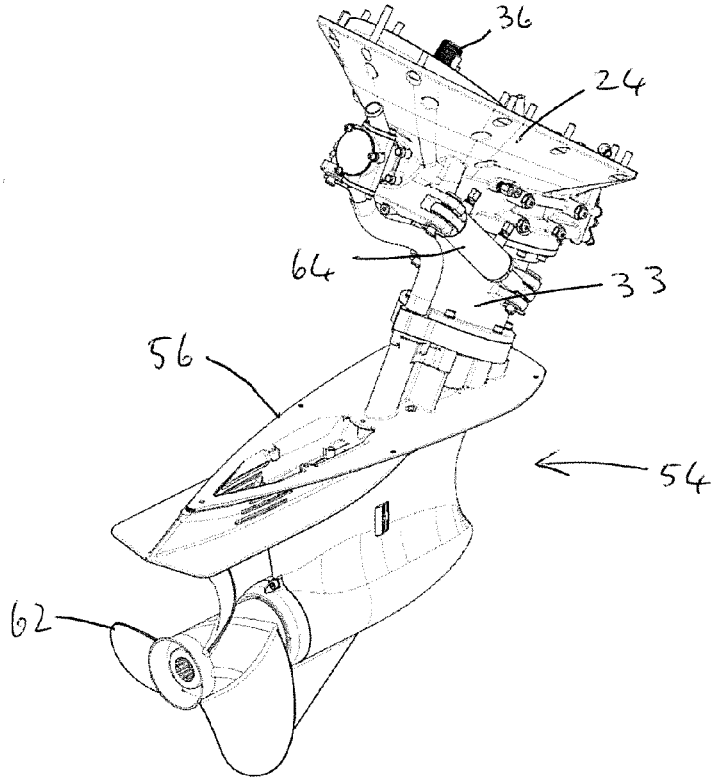
FIG. 10 is an isometric, aft, starboard view of a lower unit of the outboard motor of FIG. 1, with covers removed.
Figure 11:
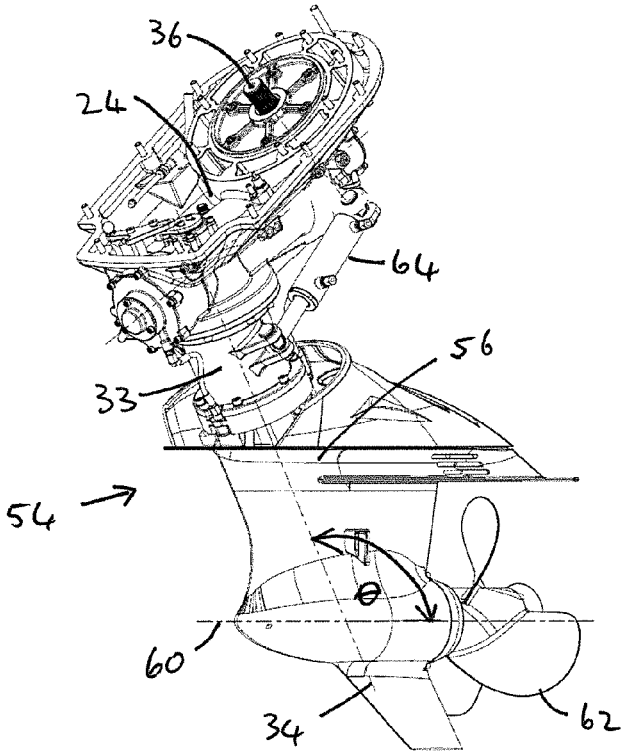
FIG. 11 is an isometric, fore, port view of the lower unit of FIG. 10.
Figure 12:
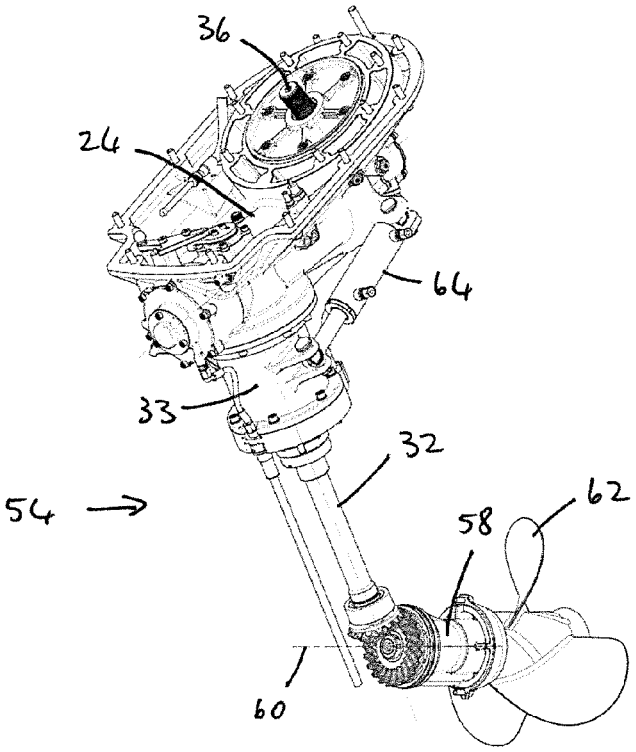
FIG. 12 is an isometric, fore, port view of the lower unit of FIG. 11 without its lower unit housing.

The upper unit 14 includes an engine 28, e.g. an internal combustion engine, to serve as motive power for the outboard motor 10. The upper unit 14 also includes a gearbox 24 that houses a drive train or transmission assembly 26 (which is shown in FIG. 9) and a drive shaft 32 (shown in broken lines in FIG. 9) extends from the transmission assembly with its drive shaft axis 34 at an angle of about 60 degrees when the outboard motor 10 is in its normal, tilted down, operational orientation.

The transmission assembly 26 (inside the gearbox 24) includes an input shaft 36 that receives motive power from the engine 28. The input shaft 36 can be connected to the engine 28 by any suitable means—preferably coaxially with the crank axis 30, but in a preferred embodiment (and as illustrated), the input shaft connects coaxially with the engine's crank shaft. The input shaft 36 (and thus also the crank axis 30) form an acute angle $\alpha$ with the longitudinal axis 13 of the boat when the outboard motor 10 is in its normal, tilted down, or operational orientation shown in FIGS. 1, 2 and 5-8. The acute angle $\alpha$ can be any acute angle, although it is preferably between about 20 degrees and 70 degrees—more preferably about 45 degrees, as shown in the illustrated embodiment. The acute angle $\alpha$, i.e. the diagonal orientation of the crank axis 30 and input shaft 36, allows the engine 28 to be supported relatively close to the transom 12 (i.e. not far behind the boat), yet to avoid encroachment of the engine into the boat's hull. The engine 28 preferably operates with a dry sump, and/or with other adaptations that allows it to run with a 45 degree slanted crank axis, but also with the crank axis closer to horizontal, if the engine is tilted up.

The transmission assembly 26 further includes a clutch shaft 40 with its axis in a vertical plane that extends parallel to the longitudinal axis 13 of the boat and with the axis of the clutch shaft extending at an angle of about 30 degrees relative to the horizontal (i.e. perpendicular to the drive shaft axis 34). The clutch shaft 40 thus has an angled fore-aft orientation, but pivots up and down about the trim axis 20 with the rest of the upper unit 14. The clutch shaft 40 receives motive power from the input shaft 36 via a pivot gear set 42 of bevel gears.

The transmission assembly 26 further includes a clutch assembly 44 that is configured to transfer motive power selectively from the clutch shaft 40 to the drive shaft 32. The clutch assembly 44 includes a pair of bevel gears that are supported to rotate about the clutch shaft 40 and the pair of bevel gears includes a forward gear 46 and a reverse gear 48. A clutch element 50 is also supported on the clutch shaft 40, between the pair of bevel gears 46,48 and is configured to slide selectively, axially along the clutch shaft, to connect the forward gear or the reverse gear to the clutch shaft, to receive motive power from the clutch shaft. The forward gear 46 and the reverse gear 48 are meshed on opposing sides with a driven bevel gear 52 on an upper end of the drive shaft 32, so that the drive shaft receives motive power from the clutch assembly 44 either via the forward gear or reverse gear, depending on which one is engaged by the clutch element 50.

The outboard motor 10 also includes a lower unit 54 that is attached to a lower end of the upper unit 14. The lower unit includes a lower unit housing 56 and the drive shaft 32 extends from the upper unit 14 into the lower unit housing (preferably by way of a splined extension), to provide motive power to a propeller shaft 58 that is supported in the lower unit housing to rotate about its propeller axis 60. The drive shaft 32 is supported coaxially inside a cylindrical drive shaft casing 33 that is attached to the lower unit housing 56 and forms part of the lower unit 54, even though it is shown in FIG. 9. The propeller shaft 58 protrudes aft from the lower unit housing 56 and can carry a propeller 62 for propulsion of the boat. The propeller shaft 58 extends generally horizontally (when the outboard motor 10 is in its normal operational orientation and the lower unit 54 extends dead ahead—i.e. is not turned) and motive power is transferred from the drive shaft 32 to the propeller shaft by a lower unit gear set (not shown).

The lower unit 54 can pivot relative to the upper unit 14 in steering directions about the drive shaft axis 34—which thus also serves as a steering axis. The pivotal movement of the lower unit 54 about the steering axis 34 is actuated by a steering system which in the illustrated embodiment includes two actuators in the form of hydraulic steering cylinders 64 acting between the drive shaft casing 33 (which is connected to the lower unit housing 56) or other part of the lower unit 54 and the pivoting mounting bracket 18, or other part of the upper unit 14.

Thus, in use, the outboard motor 10 is trimmed and/or tilted by pivotal movement of the upper and lower units 14,54, together, about the trim axis 20, as described above. However, apart from occasional trim operations, while the outboard motor 10 is in use to propel the boat, the entire upper unit 14 remains stationary relative to the boat during use (excluding internal operational movements of the engine 28 and transmission assembly 26) and the only part that is moved to steer the boat, is the relatively small lower unit 54 that is pivoted about the steering axis 34—which coincides with the drive shaft axis.

Figure 5:
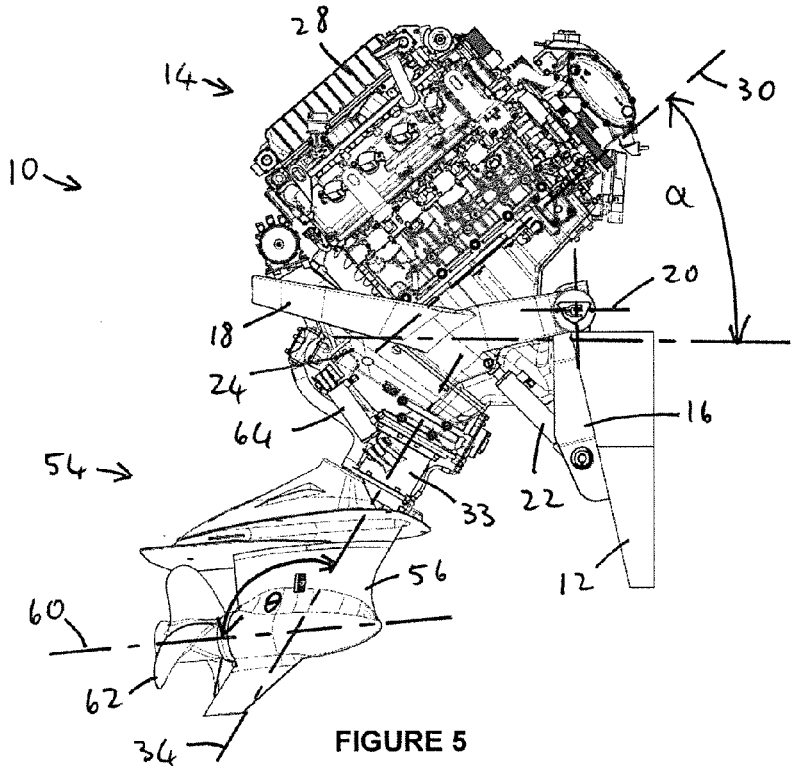
FIG. 5 is a starboard side view of the outboard motor of FIG. 1, in a port turn.
Figure 6:
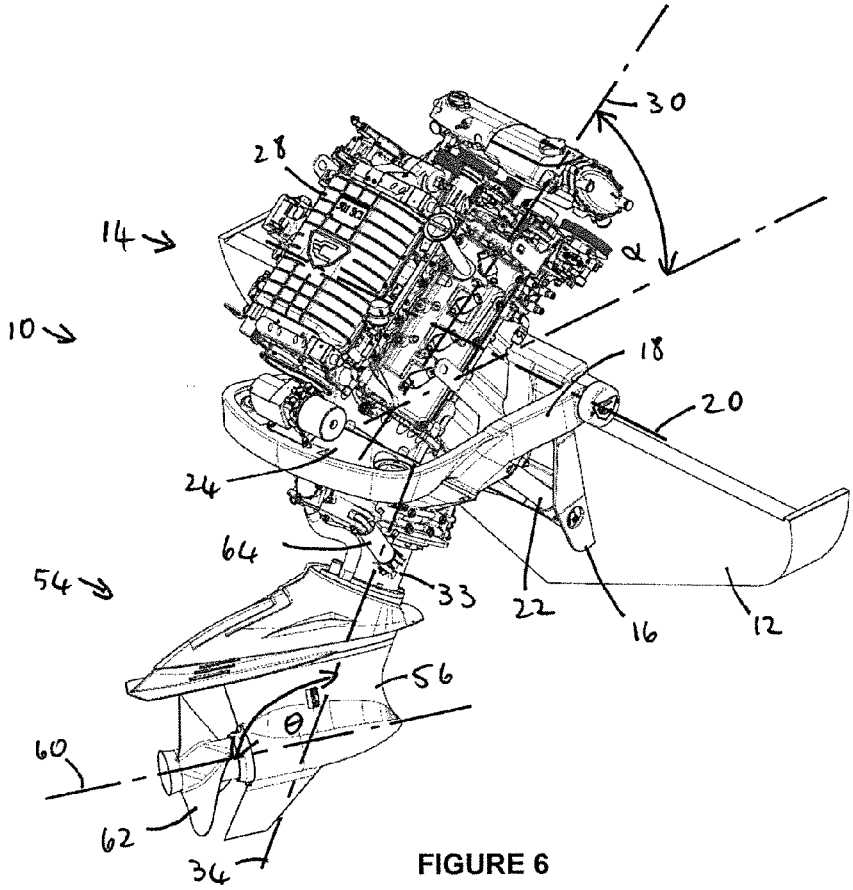
FIG. 6 is an isometric, aft starboard view of the outboard motor of FIG. 5, in a port turn.
Figure 7:
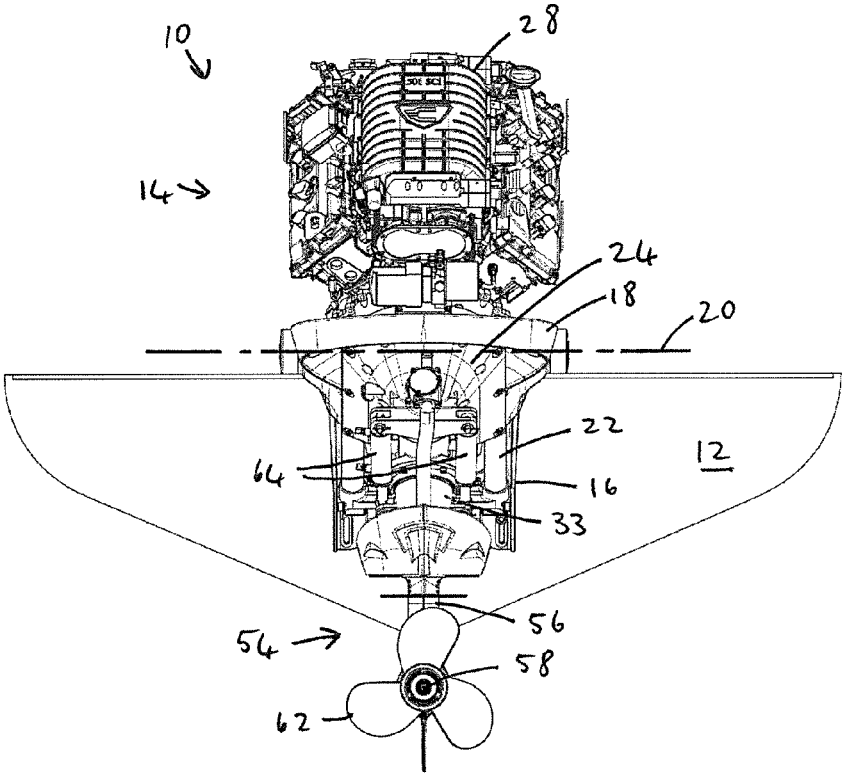
FIG. 7 is an aft view of the outboard motor of FIG. 1.
Figure 8:
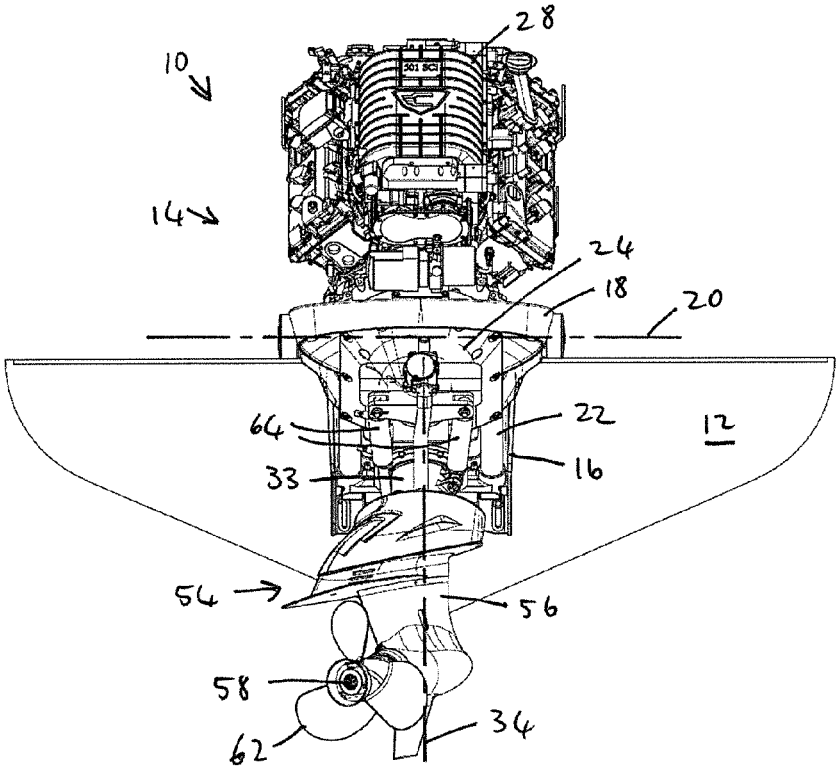
FIG. 8 is an aft view of the outboard motor of FIG. 7 in a port turn.

The drive shaft 32 has an angled or inclined orientation, with an obtuse angle θ formed between the steering axis 34 and the propeller axis 60. The obtuse angle θ is preferably between 100 and 140 degrees, more preferably about 120 degrees, as shown in the illustrated embodiment. As mentioned above, the lower unit 54 is configured to pivot relative to the upper unit 14 about the drive shaft axis 34 (which is also the steering axis). This pivotal movement changes the orientation of the propeller shaft 58 to port and starboard and thus steers the boat, without disrupting the position, operation or mechanical connection between the drive shaft 32, lower unit gear set or propeller shaft—and while requiring no movement of the upper unit 14. The steering operation of the lower unit 54 is illustrated in FIGS. 5, 6 and 8, which show the outboard motor 10 in a port turn.

The angled orientation of the drive/steering axis 34 (at about 60 degrees from horizontal) and the obtuse angle θ between the drive/steering axis and the propeller axis 60, hold the advantages of improving performance and handling of the boat when turning, because the propeller axis 60 is effectively trimmed down when turning, by virtue of its steering movement about the non-vertical steering axis. The trimming down effect on the propeller axis 60 from its steering movement, also avoids or minimises the directional thrust experienced with conventional outboard motors (with vertical steering axes), when trimmed up. Cavitation and aeration are also reduced by the trimming down effect of the angled steering axis 34. In addition to improved handing that results from the angled steering axis 34 (and obtuse angle θ), the angled steering axis also reduces the angle by which the outboard motor 10 has to be tilted to lift the lower unit 54, e.g. to clear the water. The reduced tilting that is required further assists in reducing the encroachment of the engine 28 in the boat hull and reduces the variations in the crank axis orientations with which the engine is required to operate.

The invention claimed is:

1. An outboard motor comprising an upper unit that is attachable to the stern of a boat and a lower unit that is attached to the upper unit; the upper unit and lower unit being configured to pivot together about a tilt axis that extends transversely relative to a longitudinal axis of the boat; the upper unit including an engine, a transmission assembly and a drive shaft; and the lower unit including a lower unit housing supporting a propeller shaft that is connected to receive motive power from the drive shaft, said propeller shaft being supported in the lower unit housing to rotate about a propeller axis;

said lower unit housing being configured to pivot relative to the upper unit about a steering axis that extends coaxially with the drive shaft, wherein said steering axis intersects the propeller axis at an obtuse angle, measured aft of the steering axis and above the propeller axis, and wherein said transmission assembly includes an input shaft that is connected to receive motive power from the engine and to transfer said motive power forward from the input shaft to the drive shaft.

2. The outboard motor according to claim 1, wherein the steering axis intersects the propeller axis at an angle between 100 degrees and 140 degrees, measured aft of the steering axis and above the propeller axis.

3. The outboard motor according to claim 2, wherein the steering axis intersects the propeller axis at an angle of about 120 degrees, measured aft of the steering axis and above the propeller axis.

4. The outboard motor according to claim 1, wherein the transmission assembly includes:

a clutch shaft that is connected to receive motive power from the input shaft, said clutch shaft extending perpendicular to the drive shaft;

a pivot gear set of bevel gears for transferring motive power from the input shaft to the clutch shaft; and a clutch assembly configured to transfer motive power selectively from the clutch shaft to the drive shaft.

5. The outboard motor according to claim 4, wherein the pivot gear set is aft of the clutch assembly.

6. The outboard motor according to claim 4, wherein the input shaft extends at an acute angle relative to the longitudinal axis of the boat, measured above the longitudinal axis of the boat and fore of the input shaft when the outboard motor is in a tilted down operational orientation.

7. The outboard motor according to claim 6, wherein the input shaft extends at an angle of between 20 degrees and 70 degrees relative to the longitudinal axis of the boat, measured above the longitudinal axis of the boat and fore of the input shaft when the outboard motor is in the tilted down operational orientation.

8. The outboard motor according to claim 7, wherein the input shaft extends at an angle of about 45 degrees relative to the longitudinal axis of the boat, measured above the longitudinal axis of the boat and fore of the input shaft when the outboard motor is in the tilted down operational orientation.

9. The outboard motor according to claim 4, wherein the axis of the clutch shaft is in a generally vertical plane that extends parallel to the longitudinal axis of the boat.

* * * * *